US011085448B2

(12) United States Patent
De Bontridder et al.

(10) Patent No.: US 11,085,448 B2
(45) Date of Patent: Aug. 10, 2021

(54) OIL CIRCUIT, OIL-FREE COMPRESSOR PROVIDED WITH SUCH OIL CIRCUIT AND A METHOD TO CONTROL LUBRICATION AND/OR COOLING OF SUCH OIL-FREE COMPRESSOR VIA SUCH OIL CIRCUIT

(71) Applicant: ATLAS COPCO AIRPOWER, NAAMLOZE VENNOOTSCHAP, Wilrijk (BE)

(72) Inventors: Thomas De Bontridder, Wilrijk (BE); Wim Meeusen, Wilrijk (BE); Edwin Roskam, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 615 days.

(21) Appl. No.: 15/958,248

(22) Filed: Apr. 20, 2018

(65) Prior Publication Data

US 2018/0306189 A1 Oct. 25, 2018

Related U.S. Application Data

(60) Provisional application No. 62/551,323, filed on Aug. 29, 2017.

(30) Foreign Application Priority Data

| | | |
|---|---|---|
| Apr. 21, 2017 | (BE) | 2017/5278 |
| Mar. 12, 2018 | (BE) | 2018/5151 |
| Apr. 9, 2018 | (BE) | 2018/5237 |

(51) Int. Cl.
*F04C 29/02* (2006.01)
*F04C 29/04* (2006.01)
(Continued)

(52) U.S. Cl.
CPC ..... *F04C 29/025* (2013.01); *F04C 2/102* (2013.01); *F04C 18/16* (2013.01); *F04C 28/06* (2013.01);
(Continued)

(58) Field of Classification Search
CPC ..... F04C 29/025; F04C 29/06; F04C 29/08; F04C 28/28; F04C 29/0014; F04C 29/04;
(Continued)

(56) References Cited

U.S. PATENT DOCUMENTS

| | | | |
|---|---|---|---|
| 3,186,630 | A | 6/1965 | Lamberton |
| 3,859,013 | A | 1/1975 | Stevenson |

(Continued)

FOREIGN PATENT DOCUMENTS

| | | | |
|---|---|---|---|
| FR | 2415198 | A1 | 8/1979 |
| JP | S6480717 | A | 3/1989 |

(Continued)

*Primary Examiner* — Michael R Mansen
*Assistant Examiner* — Robert T Reese
(74) *Attorney, Agent, or Firm* — Bacon & Thomas, PLLC

(57) ABSTRACT

An oil circuit for lubrication and cooling of an oil-free compressor with an oil reservoir and a rotary oil pump to drive oil to the compressor element and/or the motor via an oil pipe. The rotary oil pump has a rotor mounted on a rotation shaft, and is driven by the motor of the compressor. The oil circuit is provided with a bypass pipe and a pressure-actuated bypass valve which guide a portion of the oil back to the oil reservoir without this portion of the oil passing through the compressor element and/or the motor during its way back to the oil reservoir. The oil circuit is further provided with an oil cooler in the bypass pipe. The bypass valve is in the oil pipe.

20 Claims, 4 Drawing Sheets

(51) Int. Cl.

| | |
|---|---|
| ***F04C 18/16*** | (2006.01) |
| ***F04C 28/06*** | (2006.01) |
| ***F04C 29/00*** | (2006.01) |
| ***F04C 28/28*** | (2006.01) |
| ***F04C 28/08*** | (2006.01) |
| ***F04C 2/10*** | (2006.01) |

(52) U.S. Cl.
CPC ..... *F04C 28/08* (2013.01); *F04C 28/28* (2013.01); *F04C 29/0014* (2013.01); *F04C 29/028* (2013.01); *F04C 29/04* (2013.01); *F04C 2240/809* (2013.01); *F04C 2240/81* (2013.01)

(58) Field of Classification Search
CPC .... F04C 2/102; F04C 18/16; F04C 2240/809; F04C 2240/81
See application file for complete search history.

(56) References Cited

U.S. PATENT DOCUMENTS

| | | | | |
|---|---|---|---|---|
| 3,995,978 | A | 12/1976 | Khan | |
| 5,256,042 | A * | 10/1993 | McCullough | F04C 29/025 418/1 |
| 6,182,467 | B1 * | 2/2001 | Zhong | F25B 31/008 62/470 |
| 2003/0059326 | A1 | 3/2003 | Douzono | |
| 2005/0188708 | A1 * | 9/2005 | Wills | F04C 29/0085 62/175 |
| 2007/0048147 | A1 * | 3/2007 | Dunn | F04C 28/24 417/310 |
| 2017/0101991 | A1 * | 4/2017 | Yenneti | B01D 53/263 |
| 2017/0298937 | A1 | 10/2017 | Seghers | |
| 2018/0094584 | A1 * | 4/2018 | Chalaud | F25B 41/20 |
| 2018/0258952 | A1 * | 9/2018 | Meeusen | F04D 29/063 |
| 2019/0390673 | A1 * | 12/2019 | Hebrard | F04C 27/008 |
| 2019/0390674 | A1 * | 12/2019 | Hebrard | F04C 18/16 |
| 2020/0158112 | A1 * | 5/2020 | Feiler | F04C 29/025 |

FOREIGN PATENT DOCUMENTS

| | | | |
|---|---|---|---|
| JP | H0579428 | A | 3/1993 |
| WO | 2016041026 | A1 | 3/2016 |

* cited by examiner

OIL CIRCUIT, OIL-FREE COMPRESSOR PROVIDED WITH SUCH OIL CIRCUIT AND A METHOD TO CONTROL LUBRICATION AND/OR COOLING OF SUCH OIL-FREE COMPRESSOR VIA SUCH OIL CIRCUIT

The present invention relates to an oil circuit, an oil-free compressor provided with such oil circuit and a method to control lubrication and/or cooling of such oil-free compressor via such oil circuit.

BACKGROUND OF THE INVENTION

More specifically, the invention is intended to provide an improved oil circuit and an improved method to control lubrication and/or cooling of an oil-free compressor comprising a motor with a variable rpm or speed, i.e. with a variable speed drive (VSD) control, via this improved oil circuit.

It is known that an oil circuit is used to lubricate and cool components in such a motor.

These components are for example, but not limited to, bearings and gears of the motor.

At high motor rpms these bearings and gears need a precisely dosed oil lubrication: neither too much oil, which may lead to hydraulic losses and even overheating; nor too little oil, which may result in excessive friction and overheating.

Therefore, oil jet lubrication is applied, whereby oil is targeted precisely to a location where the oil is needed by means of nozzles with a very precise configuration.

This location may be a raceway of the bearings or the location where teeth of the gears engage with each other.

The oil in the oil circuit needs to be cooled, in order to avoid overheating of the oil in the oil circuit and concomitant changes in lubricating properties of the oil.

The oil circuit which provides the nozzles with filtered and cooled oil at a preset pressure level, typically comprise an oil reservoir, a rotary oil pump, an oil cooler, an oil filter, and connecting pipes, which may be integrated in other components of the oil-free compressor. Furthermore, there are often minimum pressure valves, bypass pipes, oil pressure sensors and oil temperature sensors.

Traditionally an oil circuit for such an oil-free compressor is arranged as follows.

Oil is pumped from an oil reservoir using a rotary oil pump, after which the oil is guided to an oil cooler. The cooler will cool the oil before it is brought to any components to be lubricated and any components to be cooled of the oil-free compressor.

During lubrication and cooling, the temperature of the oil will rise.

After the oil has flown through the components of the oil-free compressor to be lubricated and/or cooled, it will be guided back to the oil reservoir via a return pipe. The hot oil will be guided by the rotary oil pump from the oil reservoir to the oil cooler, where the oil will be cooled before being guided to the components of the oil-free compressor again.

The aforementioned rotary oil pump has an important role: if not enough oil is delivered in time to the nozzles, an insufficient lubrication may result in damage or failure of the bearings and/or gears.

It is possible to make use of a rotary oil pump which is driven by a separate motor.

This has the advantage that the rotary oil pump may be controlled, but the disadvantage that a separate motor and control unit for this motor are needed. As a result, the oil-free compressor will not only be more expensive, but also larger and furthermore the oil-free compressor will comprise additional components which need to be maintained and are prone to failure.

For this reason, it is interesting to drive the rotary oil pump by the same motor as a compressor element of the oil-free compressor. This will ensure that the rotary oil pump is working when the compressor element is in operation. This also means that at a higher speed or rpm of the motor and the compressor element of the oil-free compressor, when more oil is required for lubrication and cooling of the oil-free compressor, more oil is pumped and guided to the oil cooler and then the motor and/or the compressor element.

However, the oil pressure may not rise too high, and at higher speeds or rpm of the motor and the compressor element, the rotary oil pump will pump so much oil that the pressure becomes too high. Too high an oil pressure is not allowed, for example because too much oil is then used for the bearing lubrication such that the losses in the bearings rise.

That is why a bypass pipe with a valve is affixed in the oil circuit downstream the oil cooler, which as of a certain speed will drive a portion of the pumped oil back to the oil reservoir.

The higher the speed of the motor, and thus the rotary oil pump, the more oil the valve will guide back to the oil reservoir via the bypass pipe.

In this way the oil pressure in the oil circuit will not rise too high.

According to a conventional oil circuit, all oil that is driven to the motor and/or the compressor element will pass via the oil cooler.

Such known oil circuits thus also present the disadvantage that at low speeds of the machine, the oil is cooled too much as the oil cooler is designed to cool the oil at the maximum speed of the machine when the oil heats up the most due to losses in the rotating parts.

As a result, at these low speeds the oil will have a high viscosity, which will lead to oil losses in the bearings.

Moreover, a large temperature difference will occur in the oil at low and high speeds.

These large temperature differences are detrimental for the motor of the oil-free compressor.

As a result of this, an oil cooler will often be chosen whose cooling capacity is adjustable, which of course is more expensive and more complex.

Moreover, it will be necessary to use a large cooler designed for the entire oil flow at maximum speed.

Suitable rotary oil pumps for the oil circuit are gear pumps, internal gear pumps, such as gerotor pumps and vane pumps.

In U.S. Pat. No. 3,995,978 a gerotor pump has been described.

Such pumps may be designed to pump up a precise amount of oil when they are driven at the same rpm as the motor of the compressor element, through an appropriate selection of the pump width and/or the number of gear teeth or vanes, which allows to mount the rotary oil pump directly on the axis of the motor which will result in a very compact, robust, efficient and inexpensive machine.

However, a disadvantage of this kind of configuration whereby the rotary oil pump is directly mounted on the axis of the motor of the compressor element, is that the rotary oil pump needs to be mounted in a relatively high position in the oil-free compressor and, consequently, that it is in a relatively high position with respect to the oil reservoir.

This means that at start-up of the oil-free compressor, the rotary oil pump first needs to suck air from the suction pipe which is fluidly connected to the oil reservoir, and subsequently needs to suck and pump oil from the oil reservoir.

This start-up is easier if there is already some oil in the rotary oil pump, such that when the rotary oil pump is starting, this oil is spread and provides for sealing in the rotary oil pump, such that the suction power of the rotary oil pump is immediately optimal.

For this reason, during assembly of the rotary oil pump, a small volume of oil is often applied in the rotary oil pump, i.e. a volume which is small with respect to total volume of oil in the oil circuit.

When the pump is however started for the first time only after a long time after its assembly, this initial volume of oil is already partly or completely evaporated and, consequently, not sufficient anymore to start the rotary oil pump in a proper way.

U.S. Pat. No. 3,859,013 describes a rotary oil pump, whereby in an inlet channel between the rotary oil pump and the oil reservoir a kind of siphon-like structure is provided, which is configured such that a small volume of oil is kept in the inlet channel near the oil reservoir. However, at start-up of the oil-free compressor, the rotary oil pump still needs to suck a considerable volume of air before the oil is sucked from the siphon-like structure.

SUMMARY OF THE INVENTION

The purpose of the present invention is to provide a solution to at least one of the aforementioned and other disadvantages.

The object of the present invention is an oil circuit for lubrication and cooling of an oil-free compressor comprising a motor with a variable speed and a compressor element driven by said motor,

- whereby this oil circuit is provided with an oil reservoir with oil and a rotary oil pump configured to drive oil from the oil reservoir through an inlet channel upstream the rotary oil pump to the compressor element and/or the motor via an oil pipe;
- whereby this rotary oil pump is provided with a rotor mounted on a rotation shaft, whereby this rotary oil pump has a swept volume, and whereby this rotary oil pump is driven by the motor of the compressor element;
- whereby the oil circuit is further provided with a return pipe configured to guide oil from the compressor element and/or the motor back to the oil reservoir;
- whereby the oil circuit is further provided with a bypass pipe and a pressure-actuated bypass valve which are configured to directly guide a portion of the oil between the rotary oil pump and the compressor element and/or the motor back to the oil reservoir without this portion of the oil passing through the compressor element and/or the motor during its way back to the oil reservoir; and
- whereby the oil circuit is further provided with an oil cooler, with the characteristic that the oil cooler is placed in the bypass pipe and that the bypass valve is placed in the oil pipe.

An advantage is that at low speeds of the compressor element, when little cooling is required, a small portion of the oil in the oil circuit will be guided via the bypass pipe and thus cooled; while at high speeds when more cooling is required, a relatively larger portion of the oil in the oil circuit will be guided via the bypass pipe and thus will be cooled more.

By cooling less at low speeds and cooling more at high speeds, the temperature of the oil will remain more constant and thus the temperature differences smaller, compared to the known cooling circuits.

Moreover, the average oil temperature will also be higher, so that the oil will have a lower viscosity, which will lead to fewer oil losses in the bearings and at other locations in the oil-free compressor where the oil is used for lubrication.

Another advantage is that at low speeds the oil will not be cooled as no oil will be guided via the bypass pipe and the oil cooler. In this way the oil will not have too great a viscosity at low speeds.

Moreover, at high speeds the oil will not get too hot, because more oil is then guided via the cooler.

Another advantage is that the oil cooler can have smaller dimensions, i.e. in the bypass pipe a smaller oil cooler can be chosen for a smaller oil flow compared to the known oil circuits where the oil cooler is in the oil pipe upstream the bypass valve.

In a preferred embodiment of the invention, the inlet channel is provided with a dam with a height that is higher than a height of a centreline of the rotation shaft of the rotary oil pump reduced with a smallest diameter of the rotor of the rotary oil pump divided by two.

An advantage of this preferred embodiment is that it is ensured that after stoppage of the oil-free compressor a considerable volume of oil remains in the rotary oil pump and in the inlet channel between the rotary oil pump and the dam, such that at a restart of the oil-free compressor the rotary oil pump is internally completely wetted with oil and that the suction power of the rotary oil pump will immediately be very high.

In this way, oil flow is started up swiftly and smoothly in the oil circuit at the (re)start of the oil-free compressor.

Preferably, the height of the dam is smaller than the height of the centreline of the rotation shaft of the rotary oil pump reduced with a smallest diameter of the rotation shaft of the rotary oil pump divided by two.

This will prevent that oil will leak via the rotation shaft of the rotary oil pump and/or will avoid the need for additional sealings of said shaft.

The invention also concerns an oil-free compressor provided with an oil circuit for its lubrication and cooling,

- whereby this oil-free compressor comprises a motor with a variable speed and a compressor element driven by said motor;
- whereby this oil circuit is provided with an oil reservoir with oil and a rotary oil pump configured to drive oil from the oil reservoir through an inlet channel upstream the rotary oil pump to the compressor element and/or the motor via an oil pipe;
- whereby this rotary oil pump is provided with a rotor mounted on a rotation shaft, whereby this rotary oil pump has a swept volume, and whereby this rotary oil pump is driven by the motor of the compressor element;
- whereby the oil circuit is further provided with a return pipe configured to guide oil from the compressor element and/or the motor back to the oil reservoir;
- whereby the oil circuit is further provided with a bypass pipe and a pressure-actuated bypass valve which are configured to directly guide a portion of the oil between the rotary oil pump and the compressor element and/or the motor back to the oil reservoir without this portion of the oil passing through the compressor element and/or the motor during its way back to the oil reservoir; and whereby the oil circuit is further provided with an oil cooler, with the characteristic that the oil-free compressor is configured such that the oil cooler is placed in the bypass pipe and that the bypass valve is placed in the oil pipe.

Finally, the invention concerns a method to control lubrication and/or cooling of an oil-free compressor via an oil circuit, whereby this oil-free compressor comprises a motor with a variable speed and a compressor element driven by said motor;

whereby this oil circuit is provided with an oil reservoir with oil and a rotary oil pump configured to drive oil from the oil reservoir through an inlet channel upstream the rotary oil pump to the compressor element and/or the motor via an oil pipe;

whereby this rotary oil pump is driven by the motor of the compressor element;

whereby the oil circuit is further provided with a bypass pipe and a pressure-actuated bypass valve through which a portion of the oil between the rotary oil pump and the compressor element and/or the motor is directly guided back to the oil reservoir without this portion of the oil passing through the compressor element and/or the motor during its way back to the oil reservoir; and whereby the oil circuit is further provided with an oil cooler, with the characteristic that the portion of the pumped oil which is guided back to oil reservoir through the bypass pipe and the bypass valve, passes through the oil cooler which is placed in the bypass pipe, and that the bypass valve is controlled such that a preset pressure is reached in the oil pipe between the bypass valve and the compressor element and/or the motor.

Preferably, the motor of the compressor element is started only after oil or a lubricant with a higher volatility than the oil has been brought into the oil circuit at a position downstream and higher than the rotary oil pump.

BRIEF DESCRIPTION OF THE DRAWINGS

With the intention of better showing the characteristics of the invention, a few preferred embodiments of an oil circuit according to the invention and an oil-free compressor provided with such an oil circuit are described hereinafter, by way of an example without limiting nature, with reference to the accompanying drawings, wherein.

DETAILED DESCRIPTION OF THE INVENTION

Figure 1:
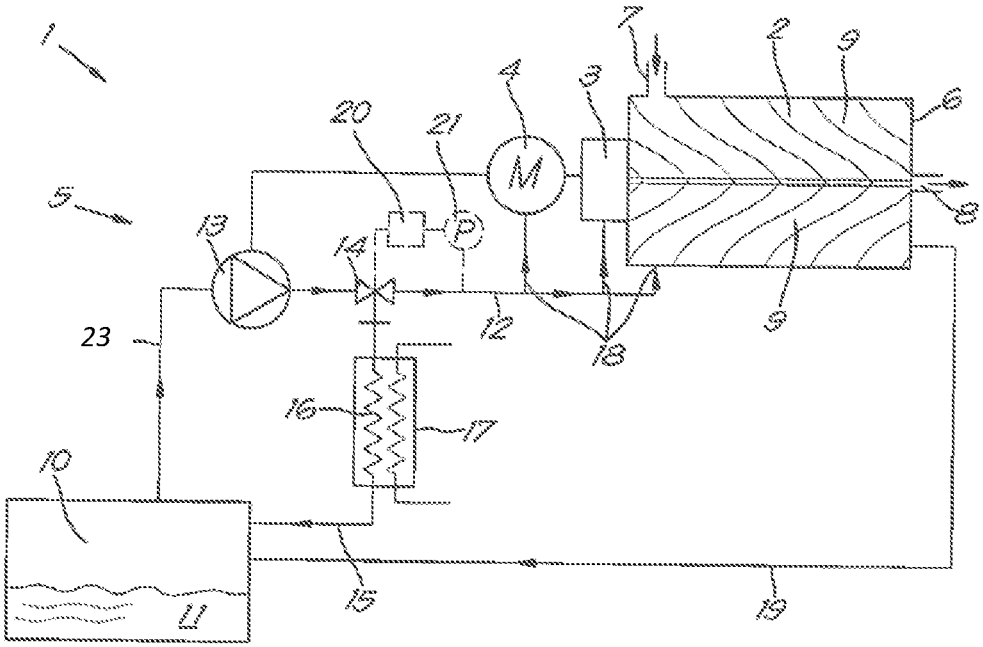
FIG. 1 schematically shows an oil-free compressor provided with an oil circuit according to the invention.

In this case the oil-free compressor 1 shown in FIG. 1 is a screw compressor device with a screw compressor element 2, a transmission 3 (or 'gearbox') and a motor 4 with variable speed, whereby the oil-free compressor 1 is provided with an oil circuit 5 according to the invention.

According to the invention, it is not necessary for the oil-free compressor 1 to be a screw compressor 1, as the compressor element 2 could also be of a different type, e.g. a tooth compressor element, scroll compressor element, vane compressor element, etc.

The compressor element 2 is provided with a housing 6 with an inlet 7 to draw in a gas and an outlet 8 for compressed gas. Two mating helical rotors 9 are mounted on bearings in the housing 6.

The oil circuit 5 will supply the oil-free compressor 1 with oil 11 to lubricate and if need be cool the components of the oil-free compressor 1.

These components are for example the gears in the transmission 3, the bearings on which the helical rotors 9 are mounted in the compressor element 2, etc.

The oil circuit 5 comprises an oil reservoir 10 with oil 11 and an oil pipe 12 to bring the oil 11 to the components of the oil-free compressor 1 to be lubricated and/or cooled.

A rotary oil pump 13 is provided in the oil pipe 12 to be able to pump oil 11 from the oil reservoir 10.

The rotary oil pump 13 is driven by the motor 4 of the compressor element 2.

The rotary oil pump 13 can be connected directly to the shaft of the motor 4 or to a drive shaft. This drive shaft is then connected to the motor 4 via a coupling. Then the gear is mounted on the driveshaft that is driven by the gearbox. One or more compressor elements 2 can be driven via the gearbox.

A bypass valve 14 and a bypass pipe 15, that leads from the oil pipe 12 back to the oil reservoir 10, are provided in the oil pipe 12 downstream from the rotary oil pump 13.

Although in the example shown the bypass valve 14 is affixed in the oil pipe 12, it is not excluded that the bypass valve is affixed in the bypass pipe 15. It is not excluded either that a three-way valve is used that is affixed at the location of the connection of the oil pipe 12 to the bypass pipe 15.

The bypass valve 14 will distribute the oil 11 that is pumped by the rotary oil pump 13: a part will be driven to the components of the oil-free compressor 1 to be lubricated and/or cooled via the oil pipe 12, the other part will be driven back to the oil reservoir 10 via the bypass pipe 15.

In this case, but not necessarily, the bypass valve 14 is a mechanical valve 14.

In a preferred embodiment, the valve 14 is a spring-loaded valve, i.e. the valve 14 comprises a spring or spring element, whereby the spring will open the valve 14 more or less depending on a pressure p upstream or downstream the valve 14.

In this case the valve will be a spring-loaded valve 14 that will close and open the bypass pipe 15 depending on the pressure p downstream of the valve 14. When a certain threshold value of the pressure p is exceeded, the valve 14 will open the bypass pipe 14 so that a portion of the pumped oil 11 will flow via the bypass pipe 15 to the oil reservoir 10.

According to the invention an oil cooler 16 is placed in the bypass pipe 15. This means that the oil 11 that flows via the bypass pipe 15 can be cooled, but that the oil 11 that flows via the oil pipe 12 to the components to be lubricated and/or cooled will not be cooled.

In other words: cooled cold oil 11 will be guided to the oil reservoir 10 via the bypass pipe 15.

In this case the aforementioned oil cooler 16 forms part of a heat exchanger 17. The oil cooler 16 could be a plate cooler for example, but any type of cooler that is suitable for cooling the oil 11 can be used in this invention.

In this case the oil cooler 16 has a fixed or constant cooling capacity for a given oil flow and flow of a coolant. This means that the cooling capacity cannot be adjusted. By adjusting the flow of the coolant, it would indeed be possible to adjust the cooling capacity. However, this is not necessary.

From the bypass valve 14, the oil pipe 12 runs to the components of the oil-free compressor 1 to be lubricated and cooled if need be. Here the oil pipe 12 will be divided into subpipes 18 that may be partly integrated in the compressor element 2.

Furthermore, the oil circuit 5 is provided with a return pipe 19 to carry the oil 11 from the compressor element 2 back to the oil reservoir 10, after it has lubricated and if need be cooled the components.

This oil 11 will have a higher temperature.

In the oil reservoir 10 this hot oil 11 will be mixed with the cooled cold oil 11 that is guided to the oil reservoir 10 via the bypass pipe 15.

The operation of the oil-free compressor 1 with the oil circuit 5 is very simple and as follows.

When the compressor element 2 is driven by the motor 4, the mating rotating helical rotors 9 will draw in and compress air.

During the operation, the different components of the compressor element 2, the transmission 3 and the motor 4 will be lubricated and cooled.

As the rotary oil pump 13 is driven by the motor 4 of the compressor element 2, as of the start-up of the oil-free compressor 1 it will pump oil 11 and drive it to the components of the oil-free compressor 1 to be lubricated and cooled via the oil pipe 12 and subpipes 18.

Figure 2:
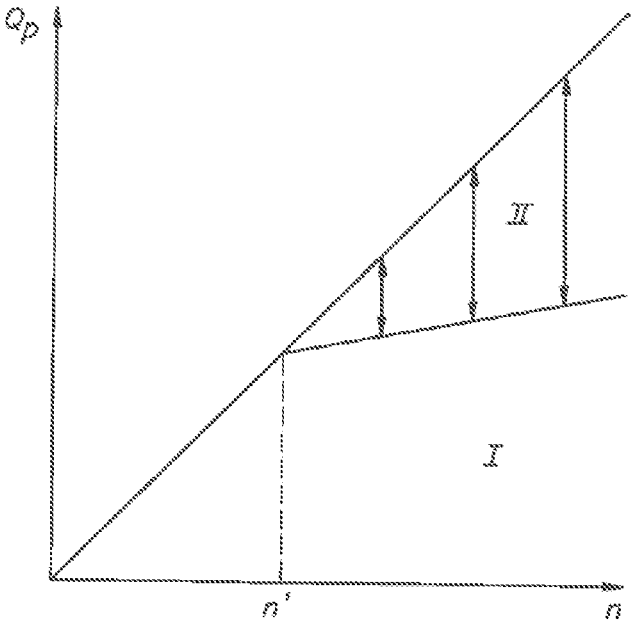
FIG. 2 schematically shows the change of the flow rate of the rotary oil pump as a function of the motor speed.

The change of the flow rate Q of the rotary oil pump 13 as a function of the speed n of the motor 4 is shown in FIG. 2.

As can be seen from this drawing, at low speeds n the rotary oil pump 13 will pump less oil 11 compared to at high speeds n. This is advantageous, as at low speeds n less lubrication and cooling will be required and more at high speeds n.

At low speeds n, all oil 11 that is pumped will be driven to the compressor element 2 and the motor 4, i.e. the bypass valve 14 will close the bypass pipe 15 so that no oil 11 can flow back to the oil reservoir 10 along the bypass pipe 15 and the oil cooler 16. As at low speeds n no cooling is required as the oil 11 will barely warm up, this is not a problem and this will ensure that the oil 11 does not get too cold.

Figure 3:
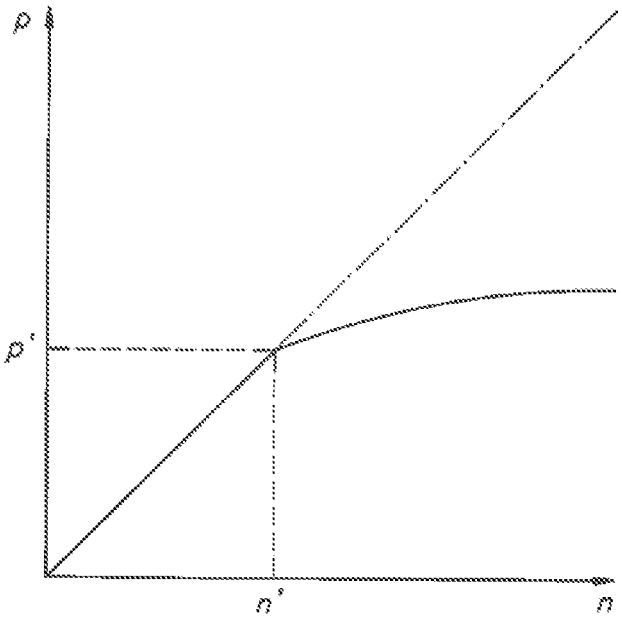
FIG. 3 shows the change of the pressure in the oil pipe downstream from the bypass valve as a function of the motor speed.

The change of the pressure p in the oil pipe 12 downstream from the bypass valve 14 is shown in FIG. 3.

The pressure will systematically rise in proportion to the speed n, until a specific pressure p' is reached corresponding to the speed n'.

As of this speed n' a pressure p' is reached such that the bypass valve 14 will partially be opened to the bypass pipe 15.

As a result, at higher speeds than n', a portion of the pumped oil 11 will be driven through the bypass valve 14 via the bypass pipe 15.

This is schematically shown in FIG. 2 whereby the curve is divided into two branches: a portion of the oil flow Q corresponding to zone I will be driven via the oil pipe 12 to the components of the oil-free compressor 1 to be lubricated and cooled, while the other portion of the oil flow Q corresponding to zone II will be driven back to the oil reservoir 10 via the bypass pipe 15.

Because the bypass valve 14 will open, as of the speed n' the pressure p will no longer rise in proportion to the speed n of the motor 4, but the curve flattens out, as shown in FIG. 3.

The higher the speed n, the more the bypass valve 15 will be pushed open by the higher pressure p downstream from the bypass valve 15 in the oil pipe 12. Indeed, at a higher speed n, the flow rate Q of the rotary oil pump 13 will be greater, so that this pressure p will also rise such that the bypass valve 14 will open more.

The spring characteristics of the spring-loaded bypass valve 14 are chosen such that the bypass valve 14 is controlled by the spring such that a preset pressure p is reached in the oil pipe 12 between the bypass valve 14 and the compressor element 2 and/or the motor 4 according to the curve of FIG. 3.

The oil 11 that is guided via the bypass pipe 15 will pass through and be cooled by the oil cooler 16.

Because the cooled oil 11 that is guided via the bypass pipe 15 comes to the oil reservoir 10, the temperature of the oil 11 in the oil reservoir 10 will fall. This cold(er) oil 11 is then pumped by the rotary oil pump 13 and brought to the compressor element 2 and/or motor 4.

As at high speeds n more heat is generated in the oil-free compressor 1, more cooling will be required which is taken care of precisely by the above method.

At increasing speeds n, the rotary oil pump 13 will always pump more oil 11 from the oil reservoir 10. As the pressure p downstream of the bypass valve 14 will always be higher as a result, this bypass valve 14 will respond to this by always guiding more oil 11 via the bypass pipe 15, so that the pressure p does not rise too high and continues to follow the curve of FIG. 3.

As a result, with increasing speeds n, ever more oil 11 will be cooled, so that the rising temperature of the oil-free compressor 1 can be accommodated at these increasing speeds n.

This is shown in FIG. 2, whereby the zone II always becomes greater at higher speeds n.

The above clearly shows that at low speeds n little or no oil 11 is cooled, while at increasing speeds n ever more oil 11 is cooled.

As a result of this, the oil temperature will be more constant and higher on average, which ensures that the viscosity of the oil 11 will be lower on average so that there are fewer oil losses in the rotary oil pump 13 and at the lubrication locations.

As can be further seen from FIG. 2, at all speeds n the oil flow Q that goes via the bypass pipe 15 and the oil cooler 16 (zone II) will be smaller than the oil flow Q that is driven to the compressor element 2 and/or the motor 4 (zone I).

This means that the oil cooler 16 can have smaller dimensions compared to the known cooling circuits.

The oil 11 of the compressor element 2 and/or the motor 4 will be driven back to the oil reservoir 10 via the return pipe 19.

This oil 11 will have a higher temperature than the oil 11 in the oil reservoir 10.

In addition to this hot oil 11, the cooled oil 11 will also come to the oil reservoir 10 via the bypass pipe 15.

The two will be mixed together in the oil reservoir 10, which will result in an oil 11 at a certain temperature between the temperature of the cooled oil 11 and the hot oil 11.

As of the oil reservoir 10, the rotary oil pump 13 will again pump the oil 11 and the method and control set out above will be followed.

Although in the example shown, a spring-loaded mechanical valve is used as a bypass valve 14, it is possible to use an electronic bypass valve 14 that is controlled by a controller 20.

In FIG. 1, this controller 20 is shown by a dotted line by way of an example. This controller 20 will control the bypass valve 14, for example on the basis of a signal from a pressure sensor 21 that is placed downstream from the bypass valve 14 in the oil pipe 12. The controller 20 will control the bypass valve 14 so that the pressure p, as registered by the pressure sensor 21, will follow the path of the curve of FIG. 3. In other words: the bypass valve 14 is controlled such that a preset pressure p is reached in the oil pipe 12 between the bypass valve 14 and the compressor element 2 and/or the motor 4.

Although in the examples shown and described, the oil circuit 5 is shown separate from the compressor element 2 and the motor 4, it is of course not excluded that the oil circuit 5 is integrated in or physically forms part of the compressor element 2 and/or the motor 4.

In all embodiments shown and described above it is possible that the oil circuit 5 also comprises an oil filter. This oil filter can for example, but not necessarily, be affixed in the oil pipe 12 downstream from the bypass valve 14. The oil filter will collect any contaminants from the oil 11 before sending it to the compressor element 2 and/or the motor 4.

Figure 4:
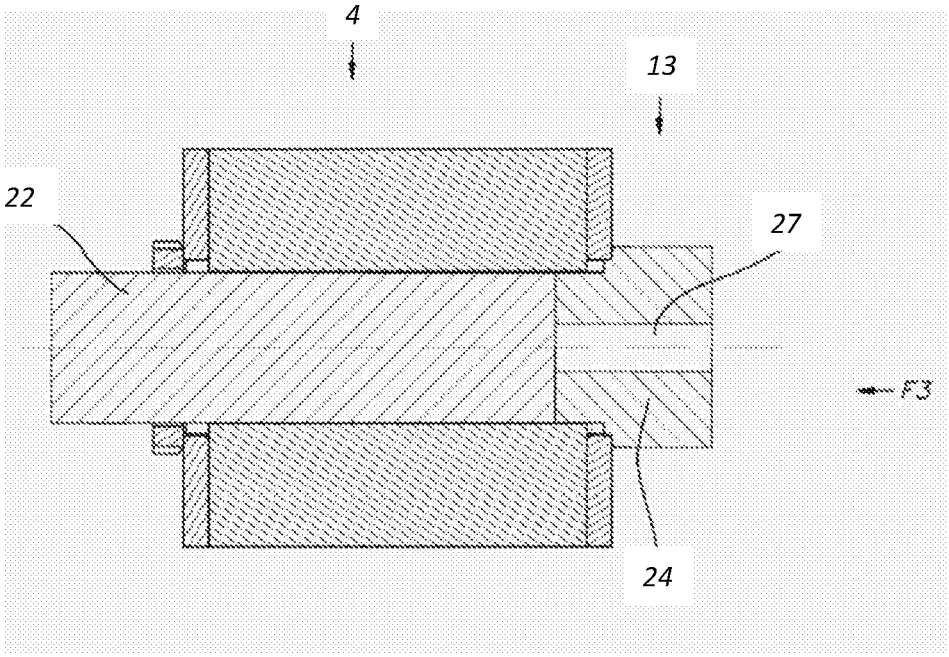
FIG. 4 schematically shows the motor and the rotary oil pump of FIG. 1 in more detail.

The motor 4 will directly drive the compressor element 2 as well as the rotary oil pump 13. In FIG. 4, it is shown that a rotation shaft 22 of the motor 4 is directly driving the rotary oil pump 13.

The oil circuit 5 will allow that the rotary oil pump 13 pumps up oil 11 from the oil reservoir 10 through an inlet channel 23 before the rotary oil pump 13, after which the oil 11 may be guided through the pipe 12 and the subpipes 18 to the nozzles that are positioned on specific locations in the motor 4 and/or the compressor element 2 for the lubrication and/or cooling of one or more bearings and other components of the oil-free compressor 1.

As the rotary oil pump 13 is driven by the motor 4 of the compressor element 2, it will be at a considerably higher position level than the oil reservoir 10. This means that the inlet channel 23, which is running from the oil reservoir 10 to the rotary oil pump 13, is relatively long.

The rotary oil pump 13 comprises a housing 24 wherein a stator 25 and a rotor 26 are mounted. The rotor 26 is mounted on a rotation shaft 27, which is driven by the rotation shaft 22 of the motor 4.

The rotary oil pump 13 is a gerotor pump, however this is not a prerequisite of the invention.

The housing 24 is provided with an inlet port 28 for oil 11, to which the inlet channel 23 is connected, and with an outlet port 29 for the pumped oil 11.

Figure 5:
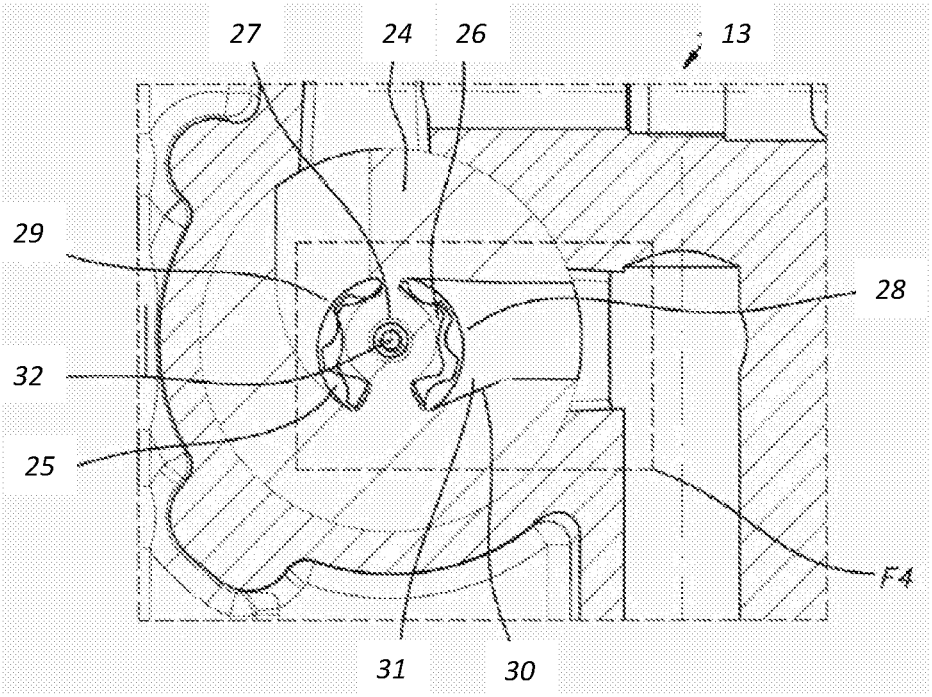
FIG. 5 shows a view according to arrow F3 in FIG. 4, whereby a housing of the rotary oil pump is partly cut away.

In FIG. 5, the inlet port 28 and the outlet port 29 are clearly visible.

Figure 6:
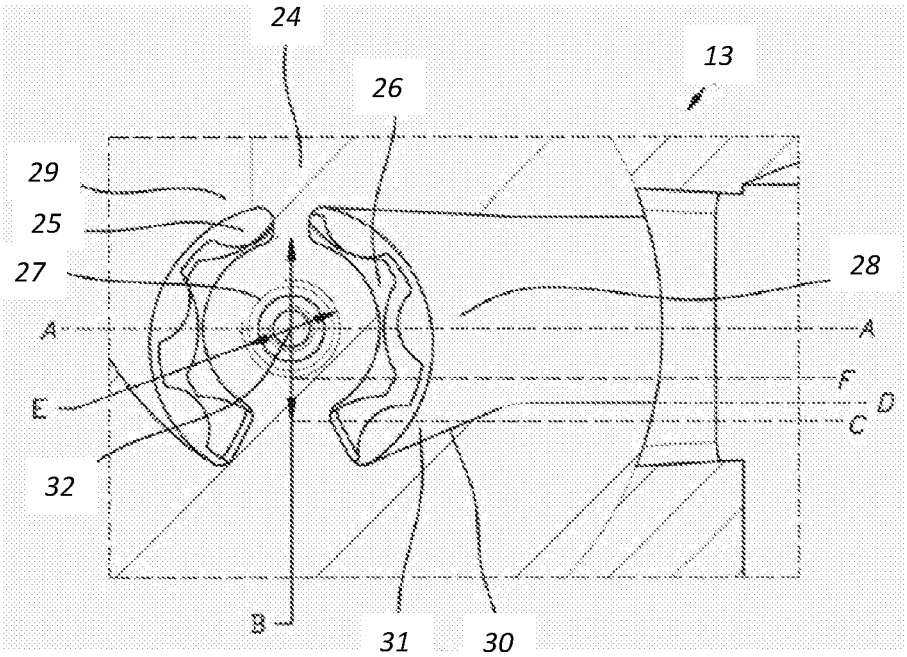
FIG. 6 shows in more detail the part that is indicated by F4 in FIG. 5.

As shown in FIG. 6, the inlet channel 23 is provided with a dam 30 near the rotary oil pump 13.

By 'dam 30' is meant a structure which ensures that, when the motor 4 has stopped, a certain volume of oil 11 will remain in a space 31 in the inlet channel 23 which is dammed by the dam 30.

By 'near the rotary oil pump 13' is meant that the aforementioned remaining volume of oil 11 will remain at a location such that the rotary oil pump 13 is able to pump up the oil 11 immediately at the start-up of the rotary oil pump 13.

This means that the aforementioned remaining volume of oil 11 will for example at least partly be present in the rotary oil pump 13 or that the remaining volume of oil 11 will be located in the inlet channel 23 right next to inlet port 28 of the rotary oil pump 13.

In FIG. 6, it is clearly visible that the dam 30 has a minimal height equal to the height A of the centreline 32 of the rotation shaft 27 of the rotary oil pump 13 reduced with half a smallest diameter B of the rotor 26 of the rotary oil pump 13.

By making the dam 30 at least as high as this minimal height, indicated by the line C, enough oil 11 will remain in the by the dam 30 dammed space 31 in the inlet channel 23 between the dam 30 and the rotary oil pump 13, whereby the rotary oil pump 13 is completely wetted internally at start-up of the oil-free compressor 1. Due to this immediate internal wetting of the rotary oil pump 13 with oil 11, the rotor 26 and the stator 25 will be immediately sealed by this oil 11 such that the suction power of the rotary oil pump 13 is immediately maximal.

In this case, and preferably, a height D of the dam 30 is smaller than a maximal height equal to the height A of the centreline 32 of the rotation shaft 27 of the rotary oil pump 13 reduced with half a diameter E of the rotation shaft 27 of the rotary oil pump 13.

If the dam 30 would be higher than this maximal height, indicated by the line F, the level of the remaining oil 11 would be higher than a lowest point of the rotation shaft 27 of the rotary oil pump 13. Because of this, oil 11 would possibly leak via the rotation shaft 27 of the rotary oil pump 13 and/or sealings would need to be provided on the rotation shaft 27 of the rotary oil pump 13 to avoid this.

Next to the minimum height C and maximum height F of the dam 30, the configuration of the dam 30 is such that in this case, and preferably, the volume of the oil 11 which might be present between the rotary oil pump 13 and the dam 30 in the rotary oil pump 13 and the inlet channel 23, is at least twice a swept volume of the rotary oil pump 13.

This has the advantage that immediately enough oil 11 is available in the rotary oil pump 13 and the inlet channel 23 at start-up of the rotary oil pump 13, such that it is not only possible to immediately wet the rotary pump 13 internally, but also to immediately pump up or pump through a volume of oil 11 via the outlet port 29 to the oil circuit 5 and so further to the components of the oil-free compressor 1 to be lubricated and/or cooled.

Despite the dam 30 in FIGS. 5 and 6 being designed as a slanting slope towards the rotor 26 and the stator 25 of the rotary oil pump 13, it is not excluded that the dam 30 has another configuration.

Figure 7:
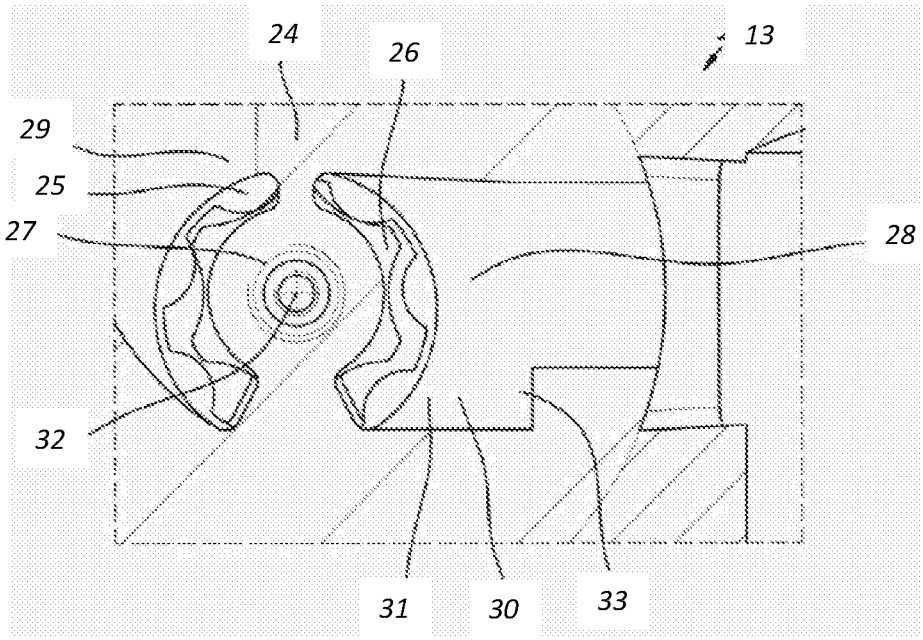
FIG. 7 shows an alternative embodiment to the part in FIG. 6.

In FIG. 7 an alternative configuration is shown, whereby the dam 30 has a stepped form, whereby the inlet channel 23 is as it were provided with a step 33.

Although this embodiment has the advantage that more oil 11 will remain in the space 31 between the dam 30 and the rotary oil pump 13, it does have the disadvantage that at the suction of the oil 11, the oil 11 so to speak flows down via the step 33, which may result in undesired turbulences. In the embodiments of FIGS. 5 and 6, the oil 11 will so to speak flow down from the dam 30.

The operation of the oil-free compressor 1 is very straightforward and as follows.

For the start-up of the oil-free compressor 1, preferably the following steps are taken:

bringing oil 11 into the oil circuit 5 at a position downstream and higher than the rotary oil pump 13 until the space 31 is completely filled with oil 11; and then starting the motor 4.

The oil 11 that is brought into the oil circuit 5 may flow down to the rotary oil pump 13 and fill both the rotary oil pump 13 and the inlet channel 23 in the space 31 between the dam 30 and the rotary oil pump 13 to a level equal to the height D of the dam 30.

When the motor 4 is then started, the compressor element 2 and the rotary oil pump 13 will be driven and the oil 11 that is brought into the oil circuit 5 and is now located in the rotary oil pump 13 and the aforementioned space 31, will ensure that the rotary oil pump 13 is able to immediately pump and transfer oil 11 to the oil circuit 5, such that the compressor element 2 is immediately provided with the necessary oil 11 right from the start-up of the oil-free compressor 1.

Alternatively, it is also possible that firstly a lubricant which is less volatile than the oil 11 is brought into the rotary oil pump 13 internally, before the motor 4 is started.

Such method is preferably applied at the assembly of the oil-free compressor 1, such that at a first start-up of the oil-free compressor 1, the less volatile lubricant is present in the rotary oil pump 13.

It is of course not excluded that both methods are combined, whereby at the first start-up a less volatile lubricant is brought in and whereby at a subsequent start-up of the oil-free compressor 1 oil 11 is brought into the oil circuit 5.

From the moment that the motor 4 is started, the rotary oil pump 13 will immediately pump up oil 11 from the oil reservoir 10 via the inlet channel 23.

The pumped oil 11 will then leave the rotary oil pump 13 via the outlet port 29 and come into the oil circuit 5 from where it is transferred to different nozzles at different to be lubricated and/or cooled components of the compressor element 2 and/or the motor 4.

The compressor element 2 and/or the motor 4 will therefore be almost immediately provided with oil 11 from the start-up of the motor 4 and the oil-free compressor 1.

It is not excluded that the oil-free compressor 1 comprises a sensor configured to register whether oil 11 is present in the space 31 between the rotary oil pump 13 and the dam 30.

The aforementioned sensor may be any type of oil-level sensor, but also an oil pressure sensor or oil temperature sensor according to the invention.

For the start-up of an oil-free compressor 1 with such sensor, the motor 4 is preferably only started after oil 11 has been detected in the inlet channel 23 between the rotary pump 13 and the dam 30.

If no oil 11 is detected, the oil-free compressor 1 is not started, but instead a warning signal is sent out to the user.

It is clear that the sensor and the aforementioned method to control the lubrication and/or cooling of the oil-free compressor 1 at start-up, may be combined with the previously described methods. This method will incorporate an additional safety feature to prevent that the oil-free compressor 1 may be started without oil 11 being present in the inlet channel 23 between the rotary oil pump 13 and the dam 30.

It is also possible that the oil-free compressor 1 comprises a fluid connection between the oil reservoir 10 and the space 31 between the rotary oil pump 13 and the dam 30, whereby the fluid connection is configured to transfer oil 11 from the oil reservoir 10 to the space 31 between the rotary oil pump 13 and the dam 30.

This may for example be realized by means of a small pump which is manually or electrically operated.

When the oil-free compressor 1 is provided with such a fluid connection, the following method may be executed for the start-up of the oil-free compressor 1:

transferring oil 11 from the oil reservoir 10 to the space 31 between the rotary oil pump 13 and the dam 30, until the space 31 is completely filled with oil 11; and then starting the motor 4.

It is of course not excluded that the oil-free compressor 1 is also provided with a sensor configured to register whether oil 11 is present in the inlet channel 23 between the dam 30 and the rotary oil pump 13.

In this case, when no oil 11 is detected at start-up, a signal will be sent out to the user to transfer oil 11 from the oil reservoir 10 to the space 31 between the rotary oil pump 13 and the dam 30 by operating the small pump or, when this small pump operates electrically, the small pump will be automatically started by the oil-free compressor 1 in order to ensure that oil 11 is transferred from the oil reservoir 10 to the space 31 between the rotary oil pump 13 and the dam 30, after which it is possible to start the motor 4 smoothly without problems.

The present invention is by no means limited to the embodiments described as an example and shown in the drawings, but an oil circuit according to the invention and an oil-free compressor provided with such an oil circuit can be realised in all kinds of forms and dimensions without departing from the scope of the invention.

The invention claimed is:

1. An oil circuit for lubrication and cooling of an oil-free compressor comprising a motor with a variable speed and a compressor element driven by said motor, whereby this oil circuit is provided with an oil reservoir with oil and a rotary oil pump configured to drive oil from the oil reservoir through an inlet channel upstream the rotary oil pump to the compressor element and/or the motor via an oil pipe;

whereby this rotary oil pump is provided with a rotor mounted on a rotation shaft, whereby this rotary oil pump has a swept volume, and whereby this rotary oil pump is driven by the motor of the compressor element;

whereby the oil circuit is further provided with a return pipe configured to guide oil from the compressor element and/or the motor back to the oil reservoir;

whereby the oil circuit is further provided with a bypass pipe and a pressure-actuated bypass valve which are configured to directly guide a portion of the oil between the rotary oil pump and the compressor element and/or the motor back to the oil reservoir without this portion of the oil passing through the compressor element and/or the motor during its way back to the oil reservoir; and whereby the oil circuit is further provided with an oil cooler, wherein the oil cooler is placed in the bypass pipe and the bypass valve is placed in the oil pipe.

2. The oil circuit according to claim 1, wherein the oil circuit is provided with only one rotary oil pump.

3. The oil circuit according to claim 1, wherein the oil cooler has a fixed or constant cooling capacity.

4. The oil circuit according to claim 1, wherein the bypass valve is a mechanical valve, preferably a spring-loaded valve.

5. The oil circuit according to claim 1, wherein the inlet channel is provided with a dam with a height that is higher than a height of a centerline of the rotation shaft of the rotary oil pump reduced with a smallest diameter of the rotor of the rotary oil pump divided by two.

6. The oil circuit according to claim 5, wherein the height of the dam is smaller than the height of the centreline of the rotation shaft of the rotary oil pump reduced with a smallest diameter of the rotation shaft of the rotary oil pump divided by two.

7. The oil circuit according to claim 5, wherein the dam is configured such that the rotary oil pump and the inlet channel are able to contain a volume of the oil between the rotary oil pump and the dam which is at least twice the swept volume of the rotary oil pump.

8. The oil circuit according to claim 5, wherein the oil circuit is provided with a sensor configured to register whether oil is present between the rotary oil pump and the dam.

9. The oil circuit according to claim 5, wherein the oil circuit is provided with a fluid connection between the oil reservoir and a space in the inlet channel between the rotary oil pump and the dam, whereby the fluid connection is configured to transfer oil from the oil reservoir to the space between the rotary oil pump and the dam.

10. An oil-free compressor comprising an oil circuit for its lubrication and cooling, whereby this oil-free compressor comprises a motor with a variable speed and a compressor element driven by said motor;

whereby this oil circuit is provided with an oil reservoir with oil and a rotary oil pump configured to drive oil from the oil reservoir through an inlet channel upstream the rotary oil pump to the compressor element and/or the motor via an oil pipe;

whereby this rotary oil pump is provided with a rotor mounted on a rotation shaft, whereby this rotary oil pump has a swept volume, and whereby this rotary oil pump is driven by the motor of the compressor element;

whereby the oil circuit is further provided with a return pipe configured to guide oil from the compressor element and/or the motor back to the oil reservoir;

whereby the oil circuit is further provided with a bypass pipe and a pressure-actuated bypass valve which are configured to directly guide a portion of the oil between the rotary oil pump and the compressor element and/or the motor back to the oil reservoir without this portion of the oil passing through the compressor element and/or the motor during its way back to the oil reservoir; and whereby the oil circuit is further provided with an oil cooler, wherein the oil-free compressor is configured such that the oil cooler is placed in the bypass pipe and the bypass valve is placed in the oil pipe.

11. The oil-free compressor according to claim 10, wherein the oil circuit is provided with only one rotary oil pump.

12. The oil-free compressor according to claim 10, wherein the oil cooler has a fixed or constant cooling capacity.

13. The oil-free compressor according to claim 10, wherein the bypass valve is a mechanical valve, preferably a spring-loaded valve.

14. The oil-free compressor according to claim 10, wherein the inlet channel is provided with a dam with a height that is higher than a height of a centreline of the rotation shaft of the rotary oil pump reduced with a smallest diameter of the rotor of the rotary oil pump divided by two.

15. The oil-free compressor according to claim 14, wherein the height of the dam is smaller than the height of the centreline of the rotation shaft of the rotary oil pump reduced with a smallest diameter of the rotation shaft of the rotary oil pump divided by two.

16. The oil-free compressor according to claim 14, wherein the dam is configured such that the rotary oil pump and the inlet channel are able to contain a volume of the oil between the rotary oil pump and the dam which is at least twice the swept volume of the rotary oil pump.

17. The oil-free compressor according to claim 14, wherein the oil circuit is provided with a sensor configured to register whether oil is present between the rotary oil pump and the dam.

18. The oil-free compressor according to claim 14, wherein the oil circuit is provided with a fluid connection between the oil reservoir and a space in the inlet channel between the rotary oil pump and the dam, whereby the fluid connection is configured to transfer oil from the oil reservoir to the space between the rotary oil pump and the dam.

19. The oil-free compressor according to claim 10, wherein the oil-free compressor is an oil-free screw compressor.

20. A method to control lubrication and/or cooling of an oil-free compressor via an oil circuit, whereby this oil-free compressor comprises a motor with a variable speed and a compressor element driven by said motor;

whereby this oil circuit is provided with an oil reservoir with oil and a rotary oil pump configured to drive oil from the oil reservoir through an inlet channel upstream the rotary oil pump to the compressor element and/or the motor via an oil pipe;

whereby this rotary oil pump is provided with a rotor mounted on a rotation shaft, and whereby this rotary oil pump is driven by the motor of the compressor element;

whereby the oil circuit is further provided with a bypass pipe and a pressure-actuated bypass valve through which a portion of the oil between the rotary oil pump and the compressor element and/or the motor is directly guided back to the oil reservoir without this portion of the oil passing through the compressor element and/or motor during its way back to the oil reservoir; and whereby the oil circuit is further provided with an oil cooler, wherein the portion of the pumped oil which is guided back to the oil reservoir through the bypass pipe and the bypass valve, passes through the oil cooler which is placed in the bypass pipe, comprising controlling the bypass valve such that a preset pressure is reached in the oil pipe between the bypass valve and the compressor element and/or motor.

* * * * *